US007645175B2

(12) United States Patent
Miyata

(10) Patent No.: US 7,645,175 B2
(45) Date of Patent: Jan. 12, 2010

(54) ENGINE COMPRISING OIL SUPPLYING APPARATUS

(75) Inventor: Shigeaki Miyata, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 2 days.

(21) Appl. No.: 11/741,598

(22) Filed: Apr. 27, 2007

(65) Prior Publication Data

US 2008/0132129 A1 Jun. 5, 2008

(30) Foreign Application Priority Data

Dec. 1, 2006 (JP) ..... 2006-325563

(51) Int. Cl.

| | |
|---|---|
| ***F02B 75/20*** | (2006.01) |
| *F01M 1/02* | (2006.01) |
| *F01M 9/10* | (2006.01) |
| *F01M 11/02* | (2006.01) |
| *F01M 1/12* | (2006.01) |

(52) U.S. Cl. ..... 440/88 L; 123/196 R; 184/6.13

(58) Field of Classification Search ..... 440/88 L; 123/196 R; 184/6.13
See application file for complete search history.

(56) References Cited

U.S. PATENT DOCUMENTS 6,537,115 B2 * 3/2003 Suganuma et al. ..... 184/6.13
6,889,651 B2 * 5/2005 Tanaka et al. ..... 123/196 R

FOREIGN PATENT DOCUMENTS

JP 2003-293721 A 10/2003

* cited by examiner

*Primary Examiner*—Daniel V Venne
(74) *Attorney, Agent, or Firm*—Keating & Bennett, LLP

(57) ABSTRACT

An oil supplying apparatus for supplying the oil to an engine of a watercraft can be provided with an oil sump, a vapor-liquid separation chamber, a scavenging pump for sending the oil in the oil sump to the vapor-liquid separation chamber, a transfer path for returning the oil from which air and blow-by gas have been separated in the vapor-liquid separation chamber to the oil sump, a feed pump for supplying the oil in the oil sump to the engine, and openings and for returning oil used to lubricate the engine to the oil sump. The oil sump can be provided below the crankcase, and the vapor-liquid separation chamber can be provided to a side surface of the engine.

24 Claims, 8 Drawing Sheets

ENGINE COMPRISING OIL SUPPLYING APPARATUS

PRIORITY INFORMATION

The present application is based on and claims priority under 35 U.S.C. § 119(a-d) to Japanese Patent Application No. 2006-325563, filed on Dec. 1, 2006, the entire contents of which is expressly incorporated by reference herein.

BACKGROUND OF THE INVENTIONS

1. Field of the Inventions

The present inventions relate to engines having an oil supply apparatus, for example, engines of watercraft.

2. Description of the Related Art

Engines used for small planing boats, such as a personal watercraft, can have an oil supplying apparatus for circulating oil throughout the internal components of the engine. For example, Japanese Patent Document JP-A-2003-293721 describes such a design. This planing boat has a dry sump type engine including a cylinder head and an oil tank. The oil tank is provided in a position lower than a cylinder head.

This boat also has a feed pump for supplying oil from an oil tank to the engine and a scavenging pump for returning oil from a bottom section of the engine to the tank. In the tank, oil and vapors, such as air and blow-by gases, are separated by the natural tendency of the vapors to aspirate out of the pooled liquid oil. A breather pipe is connected to the oil tank so as to allow the separated air and blow-by gases to be discharged from the oil tank via the breather pipe.

SUMMARY OF THE INVENTIONS

In order to sufficiently separate vapors from the oil in the system described above, a significant amount of liquid oil must remain in the tank for a significant period of time. One way to ensure such a supply of liquid oil is slow down the flow rate of the oil during the transfer from the tank back to the engine. Thus, a large capacity oil tank is required to prevent the tank from running out of oil during engine operation. On the other hand, the engine compartment of a small planing boat, such as a personal watercraft, can be narrow and thus has a limited space available for a large oil tank.

Thus, in accordance with an embodiment, an engine for a watercraft having an oil supplying apparatus for supplying lubricating oil to components of the engine can be provided. The engine can include an oil sump for collecting oil used to lubricate the engine, a vapor-liquid separation chamber for separating from the oil, air and blow-by gases included in the oil, and a first oil pump for feeding oil reserved in the oil sump to the vapor-liquid separation chamber. An oil return path can return oil, from which air and blow-by gas were separated in the vapor-liquid separation chamber, to the oil sump. Additionally, a second oil pump can supply oil reserved in the oil sump to the engine.

In accordance with another embodiment, an engine can comprise at least one moveable internal component, a lubricant sump configured to collect liquid lubricant used to lubricate the at least one moveable internal component, and a vapor separator configured to separate vapors from liquid lubricant. The vapor separator can have a vapor separator inlet and a vapor separator outlet configured to allow liquid lubricant to flow out of the vapor separator to the sump. A first lubricant pump can have a first pump inlet connected to the sump and a first pump outlet connected to vapor separator inlet. A second lubricant pump can have a second pump inlet connected to the sump and a second pump outlet arranged to guide liquid lubricant to the at least one moveable component of the engine.

In accordance with yet another embodiment, an engine can comprise at least one moveable internal component, a lubricant sump configured to collect liquid lubricant used to lubricate the at least one moveable internal component, a vapor separator configured to separate vapors from liquid lubricant, and means for defining first and second parallel lubricant circulation loops, the vapor separator being connected to the first lubricant circulation loop but not the second lubricant circulation loop.

BRIEF DESCRIPTION OF THE DRAWINGS

The above-mentioned and other features of the inventions disclosed herein are described below with reference to the drawings of preferred embodiments. The illustrated embodiments are intended to illustrate, but not to limit the inventions. The drawings contain the following Figures.

DETAILED DESCRIPTION OF THE PREFERRED EMBODIMENT

Figure 1:
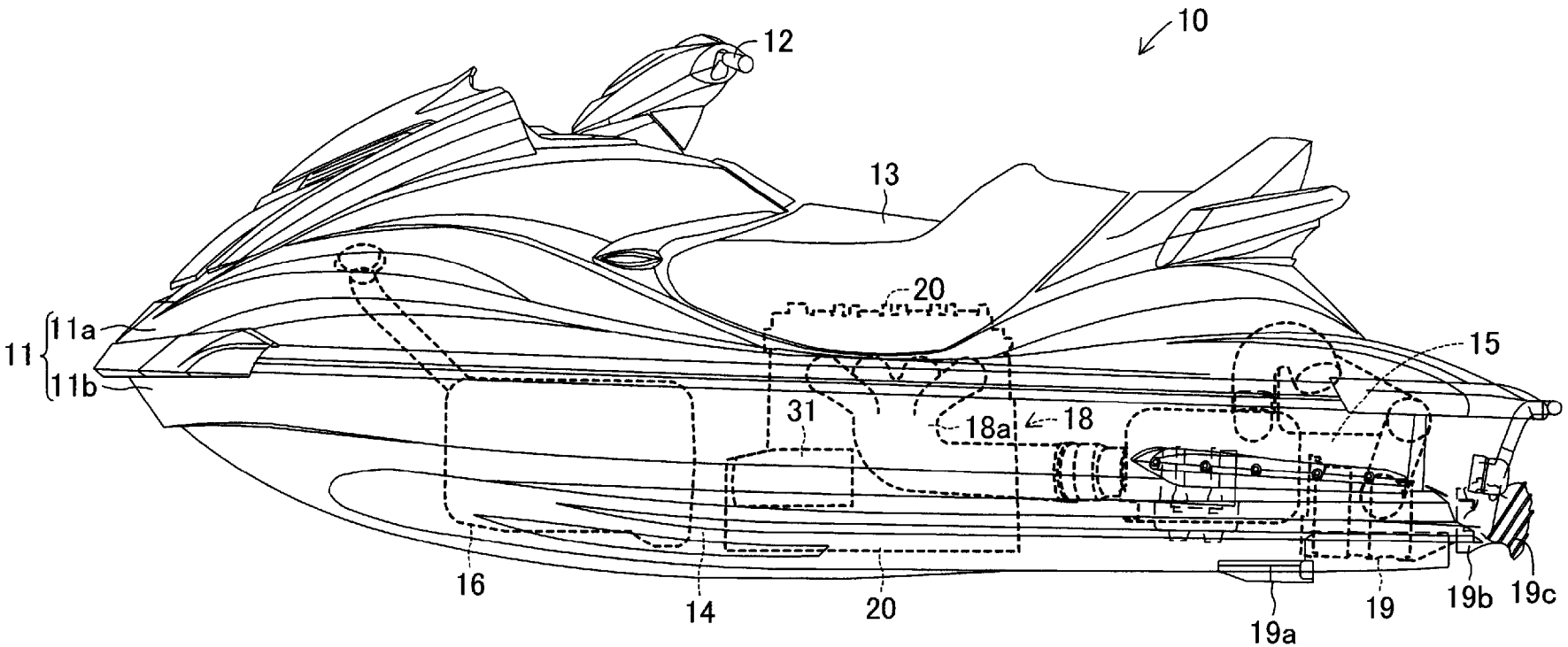
FIG. 1 is a side view showing a watercraft having an engine which includes an oil supply apparatus according to an embodiment.

FIG. 1 illustrates a personal watercraft 10 having lubrication system in accordance with several embodiments. The lubrication system is disclosed in the context of a personal watercraft because it has particular utility in this context. However, the lubrication system can be used in other contexts, such as, for example, but without limitation, outboard motors, inboard/outboard motors, and for engines of other vehicles including land vehicles.

As shown in FIG. 1, the watercraft 10 can have an engine 20 including an oil supplying apparatus (FIG. 8) according to an embodiment. The watercraft 10 can include a body 11 which can be formed with a deck 11*a* and a hull 11*b*. A steering handlebar 12 can be provided in a section forward from a center of an upper section of the body 11. A seat 13 can be centered along an upper section of the body 11. An inside of the body 11 can include the engine compartment 14 formed from a front section to a center section and a pump chamber 15 formed in a rear section.

A fuel tank 16, the engine 20, an intake apparatus 17 including a supercharger 17*a* (see FIG. 4) and other devices, and an exhaust apparatus 18 including an exhaust manifold 18*a* and other devices can be disposed in the engine compartment 14. The pump chamber 15 can have the propulsion unit 19 including a jet pump and other devices. A front section side in the engine compartment 14 can have an air duct (not shown) for leading external air into the engine compartment 14. Additionally, the engine compartment 14 can be divided into one or more discreet compartments with bulkheads (not shown).

The air duct can be formed to extend from an upper section of the body 11 to a bottom section of the engine compartment 14, and can have a structure where air outside the watercraft is taken in from a top end section and discharged into the engine compartment 14 from a bottom end section. The fuel tank 16 can be provided in a front section side of the engine compartment 14, and the engine 20 can be provided in a rear section side of the engine compartment 14 (at a center of a bottom section in the body 11). As shown FIGS. 2 and 3, the vapor-liquid separation chamber 31 forming a part of an oil supplying apparatus 30 can be formed on a side surface of the engine 20.

Figure 4:
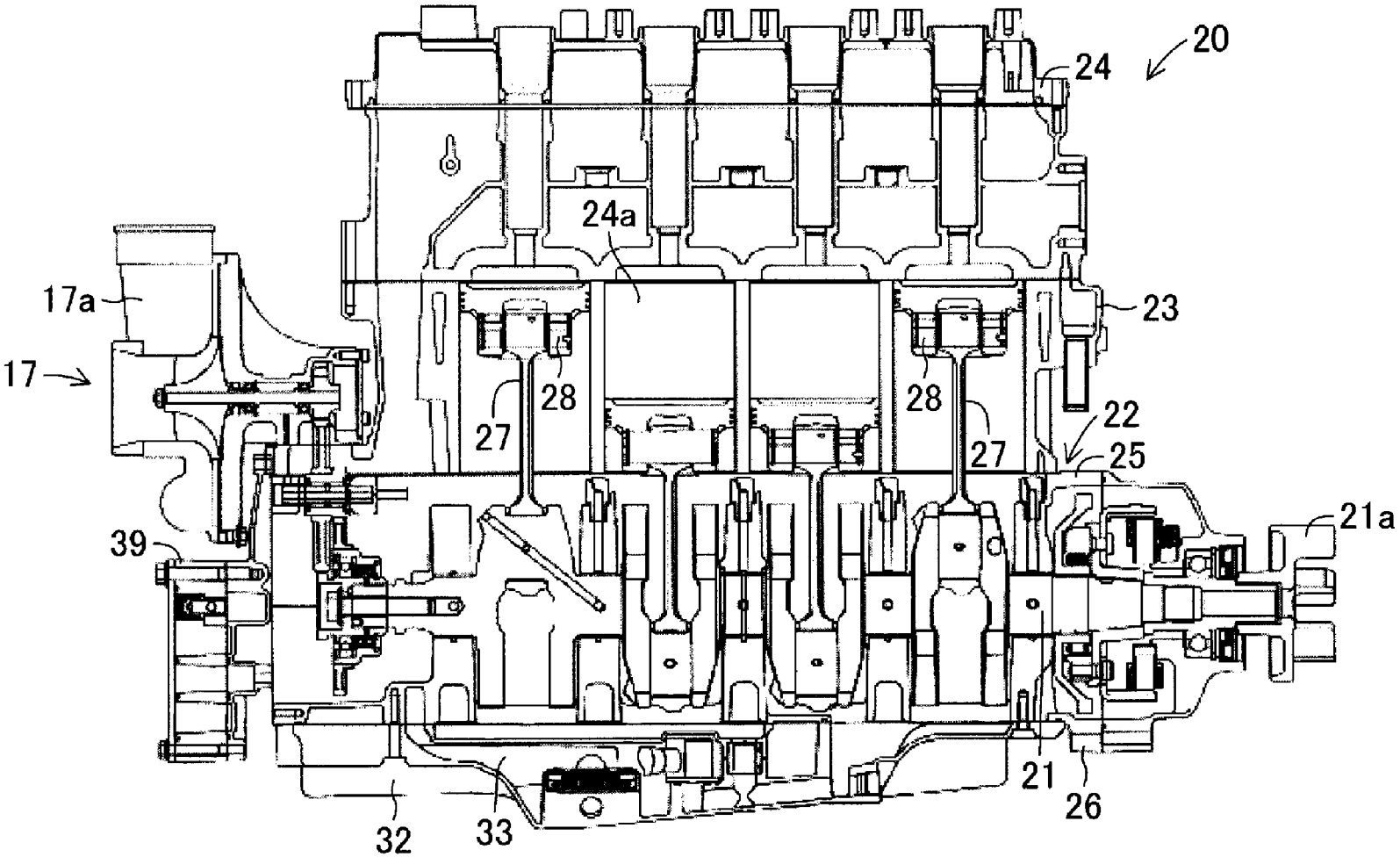
FIG. 4 is a port side and partial cross-sectional view of the engine showing some portions of an inside of the engine.
Figure 5:
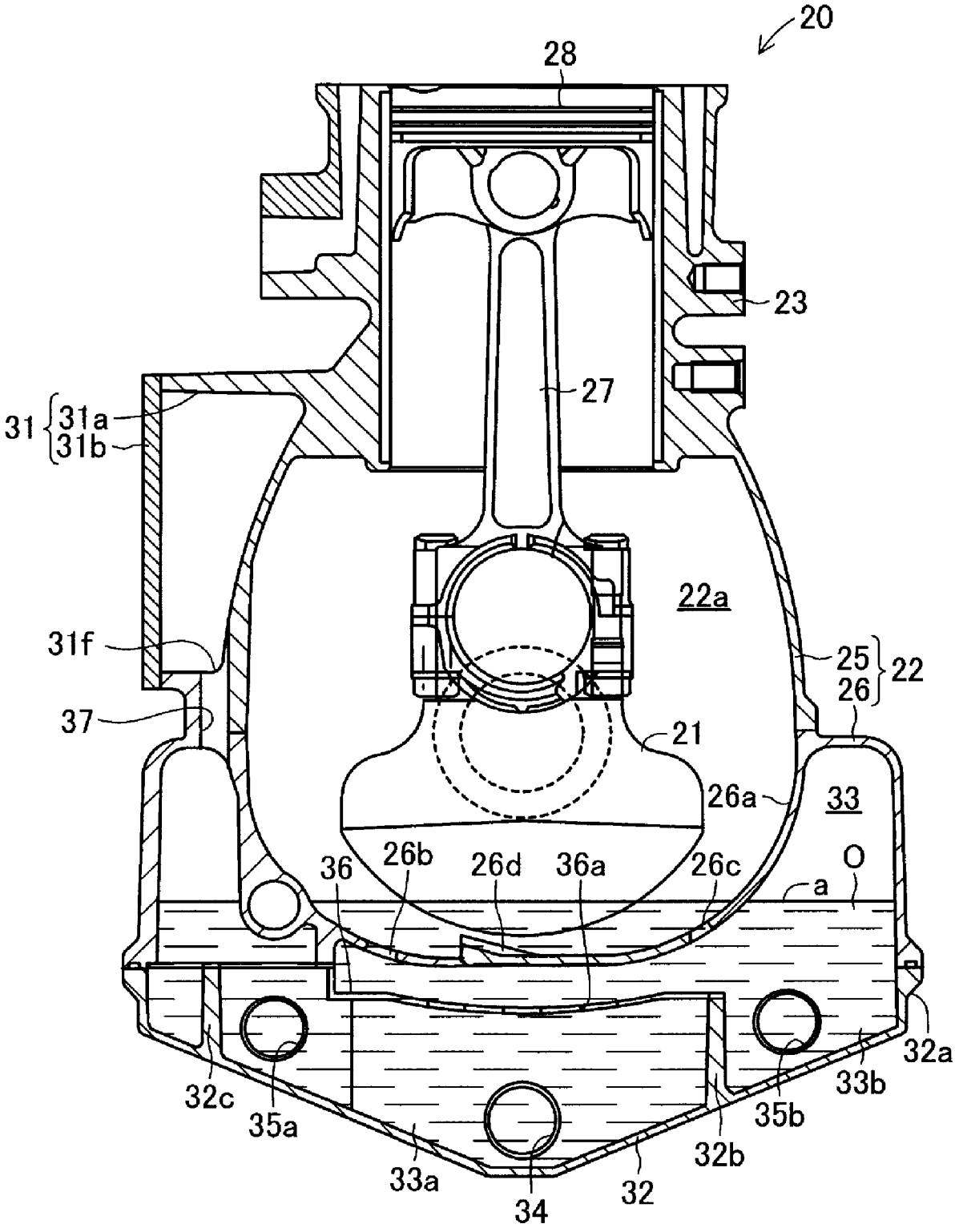
FIG. 5 is a cross-sectional view of the engine showing a state of oil in the engine when the engine is not in operation.
Figure 6:
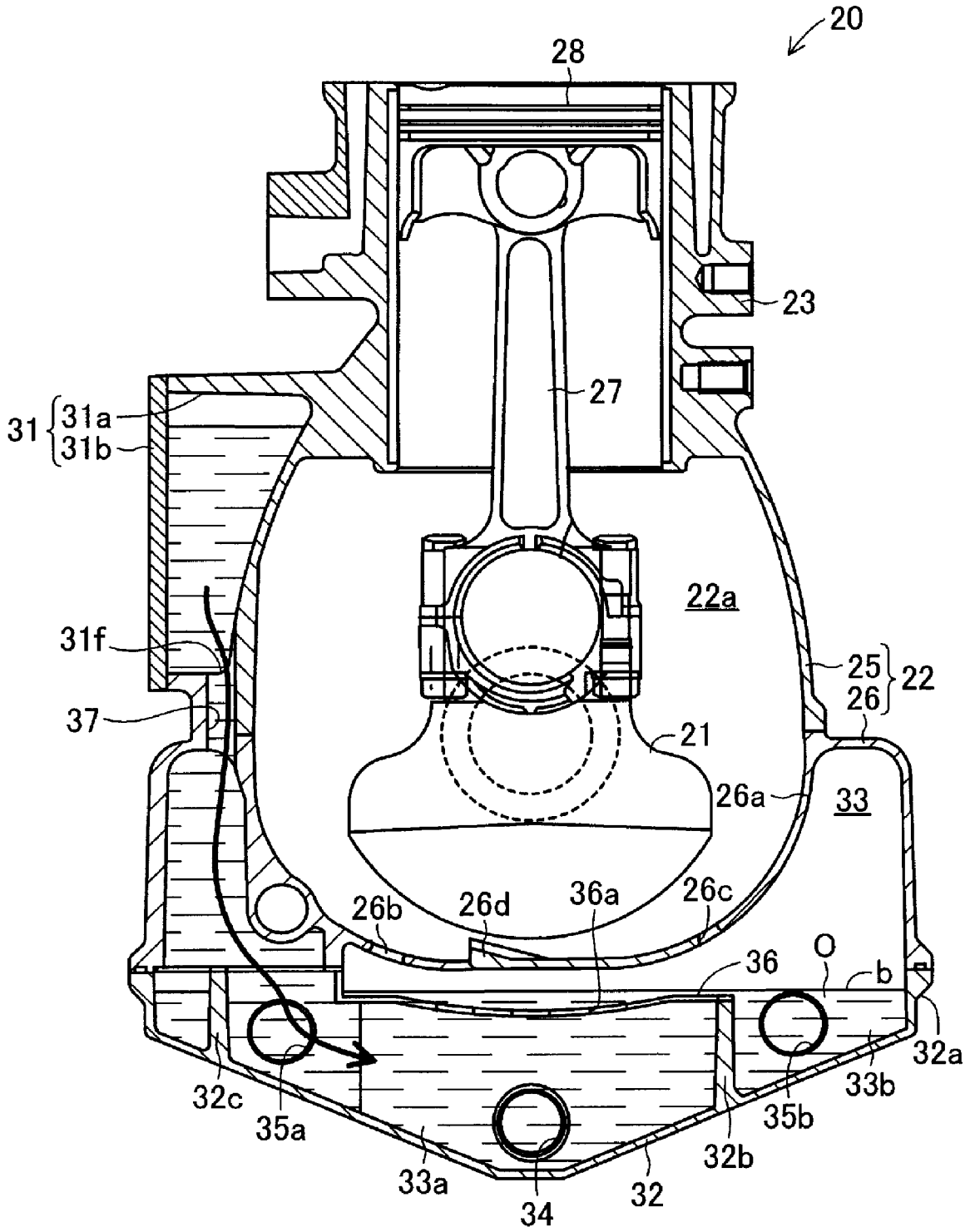
FIG. 6 is a cross-sectional view of the engine showing state of oil in the engine in operation.

The engine 20 can be a water-cooled 4-stroke engine, however, other engines having other numbers of cylinders, operating on other principles of operation (e.g., rotary, two stroke, diesel, etc) can also be used. The main body of the engine 20 can be constructed with a top section of a crankcase 22 housing a crankshaft 21 with a cylinder body 23 and a cylinder head 24 fixed in this order as shown in FIGS. 4 to 6.

Each casing member of the engine main body can be a cast block of aluminum, however, other materials and manufacturing techniques can also be used. The crankcase 22 can include the uppercase 25 and the lowercase 26. The oil sump case 32 can be mounted to a bottom surface of the lowercase 26. The oil sump case 32 can also be formed in a shape of a shallow rectangular container, however, other shapes can also be used. The oil sump 33, which can be a space for reserving the lubricating oil (O), can be formed in a space with a lower surface of the lowercase 26. However, other configurations can also be used.

Figure 7:
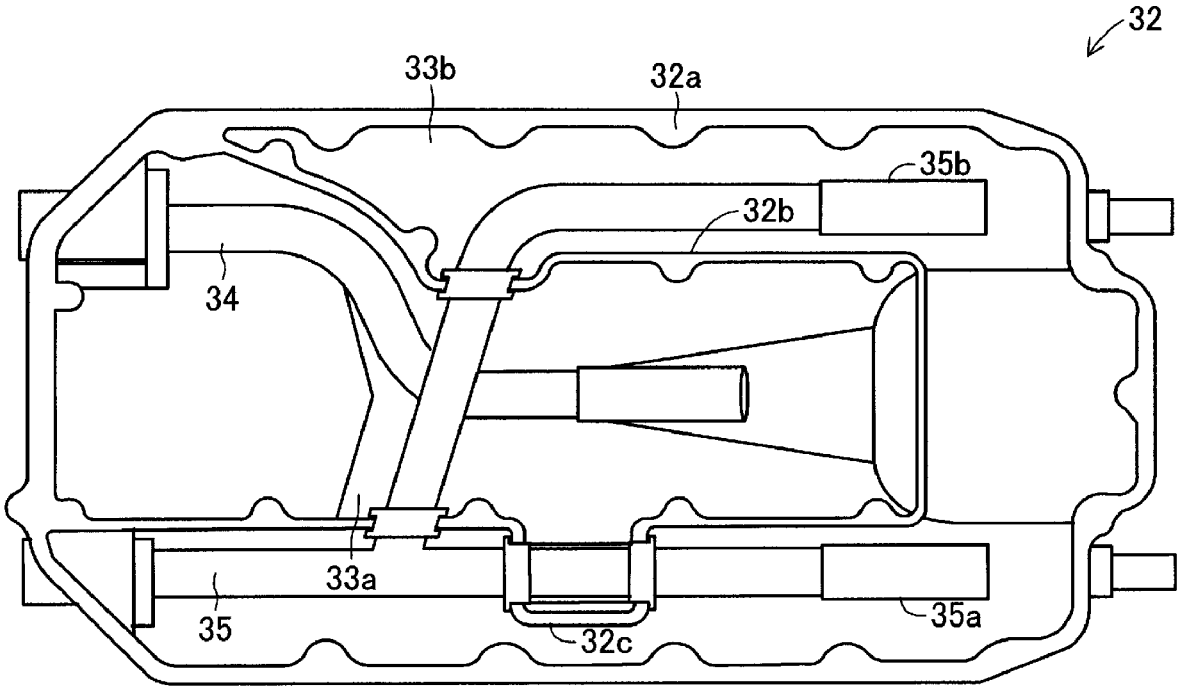
FIG. 7 is a plan view of an oil sump case of the engine.

As shown in FIG. 7, an inside of the oil sump case 32 can be divided into a plurality of parts. For example, one part can comprise a generally central area of the case 32, extending from the front end section (the left-hand side of FIG. 7) toward a rear section side (the right-hand side of FIG. 7). Another part, referred to herein as the peripheral part, can include peripheral sides of the case. In the illustrated embodiment, the peripheral part excludes the front section. However, other configurations can also be used.

Additionally, as shown in FIG. 7, wall 32*a* and 32*b* surround the peripheral part, with the wall 32*b* extending between the generally central are and the peripheral part. The generally central area can form a main oil sump 33*a*. A section on the peripheral part can form an auxiliary oil sump 33*b*.

In the main oil sump 33*a*, the feed pipe 34 can be provided. Similarly, in the auxiliary oil sump 33*b*, the scavenging pipe 35 can be provided. A rear end opening section of the feed pipe 34 can be positioned at about the center of the generally central area and can be disposed toward the rear end (toward the right-hand side of FIG. 7) of the main oil sump 33*a*, and extend toward the front (toward the left-hand side of FIG. 7) in the main oil sump 33*a*. Additionally, the feed pipe 34 can bend to extend outward toward the wall surface of the right side section (toward to top of FIG. 7) at the front end of the oil sump case 32.

Figure 8:
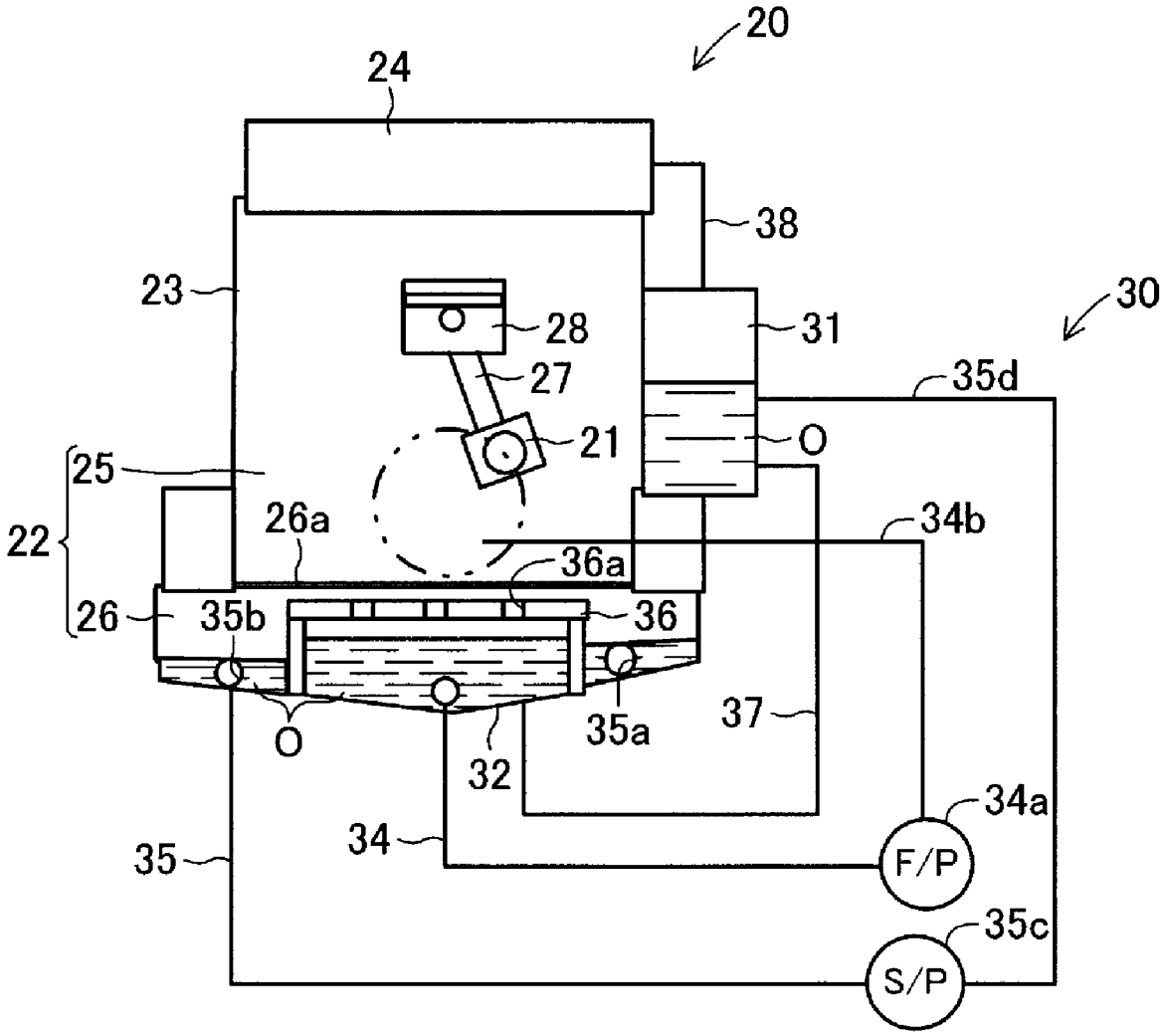
FIG. 8 is a schematic diagram showing a connection between the engine and the oil supply apparatus.

As shown in FIG. 8, the feed pump 34*a*, which can serve as the second oil pump, as referred to herein, can be connected to a section on the front end side of the feed pipe 34. The feed pipe 34 can be connected with the transfer path 34*b* for transferring the oil (O) to portions of the engine 20 via the feed pump 34*a*. As such, the vapor-liquid separation chamber 31 is not connected to the feed pump 34*a* second oil pump in series.

The scavenging pipe 35 can be formed with a forked portion dividing the pipe into two. For example, the branch pipe 35*a* can linearly extend toward the front end from the rear section side along the left side section (the bottom portion of FIG. 7) of the auxiliary oil sump 33*b*. Similarly, the branch pipe 35*b* can extend from the right side (the top portion of FIG. 7) of the case 32, toward the center side, then bending to extend through the main oil sump 33*a* and then joining to the branch pipe 35*a*. However, other configurations can also be used.

With continued reference to FIGS. 7 and 8, a section on the front end side of the scavenging pipe 35 can extend outward from the wall surface in the left side section at the front end of the oil sump case 32 and can be connected with the scavenging pump 35*c*, which can serve as the first oil pump, as that term is used herein. Furthermore, the scavenging pipe 35 can be connected with the transfer path 35*d* for transferring the oil (O) to the vapor-liquid separation chamber 31 via the scavenging pump 35*c*.

At a central area along the fore-to-aft direction of a left side section of the oil sump case 32, the dividing wall 32*b* can include a protruding wall 32*c* portion, which can be in a generally rectangular shape (one side being omitted in the plan view if FIG. 7) which thus makes the main oil sump 33*a* protrude toward the side of the auxiliary oil sump 33*b*. However, other configurations can also be used.

With reference to FIG. 6, an inside of the protruding wall 32*c* can form an inlet for leading oil (O) that has dropped from the vapor-liquid separation chamber 31 into the main oil sump 33*a*. However, other configurations can also be used to form such a drain.

With reference to FIG. 8, on a top surface of the main oil sump 33*a*, excluding a part surrounded with the protruding wall 32*c* of the oil sump case 32, the lid member 36 with a plurality of the openings 36*a* can be provided. Thus, the oil (O) having entered the oil sump 33 passes the opening 36*a* and enters the main oil sump 33*a*. Oil such as a part of the oil (O) having entered the oil sump 33, the oil (O) having dropped due to inclination of the engine 20 during a turn of the watercraft 10, and the oil (O) spilled from the main oil sump 33*a* flows into the auxiliary oil sump 33*b* on left and right sides.

The lowercase 26 positioned above the oil sump case 32 can be formed with a casing member having a rectangular outer shape whose distance in a fore-and-aft direction can be longer than a width, and its bottom surface can form a ceiling surface of the oil sump 33. A top surface of the lowercase 26 can form the bottom section 26*a* of the crankcase 22*a* formed inside the crankcase 22. A pair of openings 26*b* and 26*c* on left and right sides can be configured to allow the oil (O) in the crankcase 22*a* to drop into the oil sump 33. These openings 26*b*, 26*c* can be formed in the bottom section 26*a*. A guide section 26*d* can be configured to aid in removing the oil (O) adhering to and thus rotating with the crankshaft 21. For example, the guide section 26 *d* can protrude toward components of the crankshaft 21 so as to be opposed to a rotational direction of the crankshaft 21. Optionally, the guide section 26*d* can be formed between the openings 26*b* and 26*c* of the bottom section 26*a*.

The openings 26*b* and 26*c* allow the oil (O) in the crankcase 22*a* to collect in the oil sump 33. The uppercase 25 can be formed with a casing member formed in a manner in which the dimensions of a lower surface of the upper case 25 are generally the same as the dimensions of the top surface of the bottom section 26*a* of the lowercase 26. Additionally, a width of the upper side section can be smaller than the width of the lowercase 26. On the left side surface of the uppercase 25, the vapor-liquid separation chamber 31 communicating with the main oil sump 33*a* and the auxiliary oil sump 33*b* of the oil sump 33 via certain paths respectively can be formed.

The vapor-liquid separation chamber 31 can be formed with the lid member 31*b* in a shape of a plate for closing the concave section 31*a* mounted to an opening of the concave section 31*a* integrally formed with the uppercase 25 along a side surface of the uppercase 25. However, other configurations can also be used.

Figure 3:
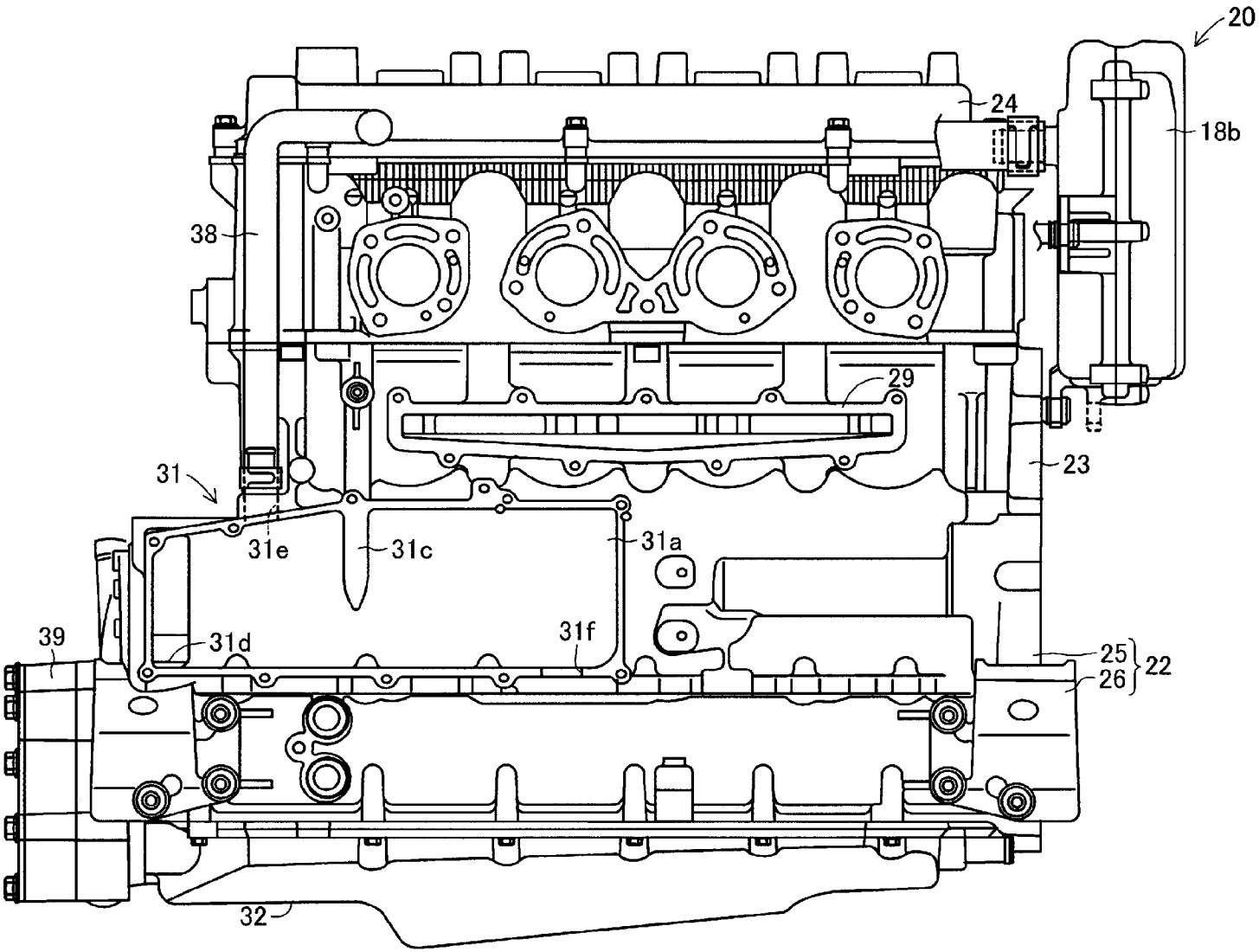
FIG. 3 is a port side view of the engine showing a state where a lid member of the vapor-liquid separation chamber shown in FIG. 2 is removed to show an inside of a concave section of the separation chamber.

As shown in FIG. 3, FIG. 5, and FIG. 6, the concave section 31*a* can be formed with a concave section in a shape generally rectangular shape. Optionally, the concave section 31 can be elongated in the fore-to-aft direction and can have a smaller width along the left-right direction. A width can be formed in a manner where the upper section side can be larger and the lower section side can be smaller along the curving outer surface of the uppercase 25.

Figure 2:
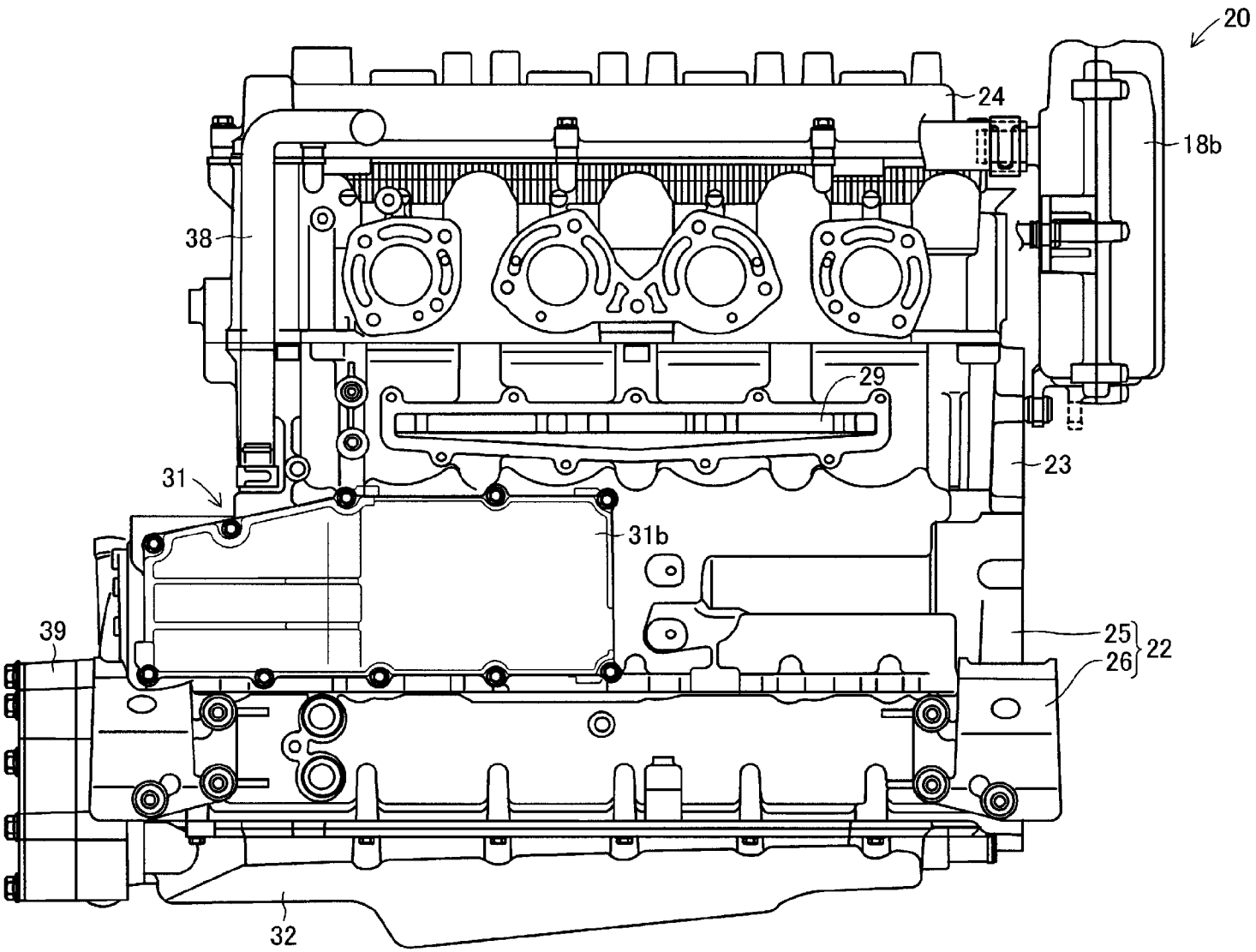
FIG. 2 is a port side view of the engine with a vapor-liquid separation chamber provided on a side surface of the engine.

With reference to FIGS. 2 and 3, a ceiling surface of a section on the front section side of the vapor-liquid separation chamber 31 can be formed on a slope where the front section side can be lower and the rear section side can be higher. The wall 31*c* (FIG. 3) for dividing an upper side section in the vapor-liquid separation chamber 31 into a front section side and a rear section side can be formed in the rear end section of the slope.

In the lower section at the front end of the vapor-liquid separation chamber 31, an oil intake opening 31*d* communicating with the transfer path 35*d* extending from the scavenging pump 35*c* can be formed. In a section almost at the center between the front end section of the ceiling surface of the vapor-liquid separation chamber 31 and a section where the dividing wall 31*c* can be formed, the gas exhaust opening 31*e* for exhausting air and blow-by gas separated from the oil (O) in the vapor-liquid separation chamber 31 can be formed. In a lower section at an rear end of the vapor-liquid separation chamber 31, an oil return opening 31*f* to allow the oil (O) from which air and blow-by gas have been separated in the vapor-liquid separation chamber 31 drop downward, can be formed. The oil return opening 31*f* can communicate with the main oil sump 33*a* via the transfer path 37 forming an oil return path to an inside of the protruding wall 32*c* formed in the oil sump case 32, as described above with reference to FIG. 7.

The cylinder body 23 can be shaped in a manner where its length along the fore-to-aft direction can be shorter than the length of the crankcase 22 along the fore-to-aft direction. Additionally, the cylinder body 23 can be shaped in a manner such that the width of the section on the lower section side can be the same as the width of the section on an upper section side of the uppercase 25.

A width of a section on the upper section side of the cylinder body 23 can be set a little smaller than the width of the section on the lower section side. A section on the upper section side of the vapor-liquid separation chamber 31 can extend up to the section on the lower section side on the left side surface of the cylinder body 23.

On the left side surface of the cylinder body 23, the breather pipe 38 can extend upwardly from the gas exhaust opening 31*e* of the vapor-liquid separation chamber 31 before bending to extend rearwardly. The breather pipe 38 can be connected with the breather case 18*b* equipped with the exhaust apparatus 18, and thus can send air and blow-by gases exhausted from the vapor-liquid separation chamber 31 to the breather case 18*b*.

The breather case 18*b* joins air and blow-by gas to intake air of the intake apparatus 17 for combustion within the engine. The cylinder head 24 can be formed with a casing member with almost the same length and width as a section on an upper section side of the cylinder body 23, and fixed to the top end section of the cylinder body 23. To the front end section of the lowercase 26, the pump housing section 39 can be provided. The feed pump 34*a* and the scavenging pump 35*c* can be formed as a unit and provided in the pump housing section 39. Furthermore, a section of the engine main body can have a water jacket 29 forming a water path of coolant to cool the engine 20.

In the cylinder body 23 of the engine main body formed as mentioned above, the piston 28 connected with the crankshaft 21 via the connecting rod 27 can be housed in a manner where it can move vertically. Vertical movement of the piston 28 can be transmitted to the crankshaft 21 to be transformed into a rotational movement of the crankshaft 21.

Each cylinder 24*a* (see FIG. 4) formed in the cylinder head 24 can have an intake valve and an exhaust valve (not shown). An intake opening communicating with an intake valve of each cylinder 24*a* can be connected to the intake apparatus 17 including the supercharger 17*a*, and an exhaust opening communicating with an exhaust valve can be connected with the exhaust apparatus 18.

An intake valve, when opened, allows air-fuel mixture provided from the intake apparatus 17 via an intake opening to flow into the cylinder head 24, during an intake stroke. The fuel of the air-fuel mixture can be provided from the fuel tank 16. The intake valve and closes during an exhaust stroke.

The exhaust valve can open to allow combustion gas to be exhausted from the cylinder head 24 via the exhaust opening by opening during the exhaust stroke to the exhaust apparatus 18 and closes during an intake stroke. The engine 20 can also include an ignition apparatus, and air-fuel mixture explodes with an ignition by the ignition apparatus. By the explosion, the piston 28 moves up and down; and by that movement, the crankshaft 21 rotates.

A pump drive shaft (not shown) can be connected with the crankshaft 21 via the coupling 21*a* and can extend from a rear section of the engine 20 into the pump chamber 15 in a rear of the watercraft 10. The pump drive shaft can be connected with the impeller provided in the propulsion unit 19 provided to a stern of the body 11, and transmits the rotational force of the crankshaft 21 given by an operation of the engine 20 to the impeller to rotate the impeller. Optionally, the drive shaft can be formed of one or a plurality of individual shafts.

The propulsion unit 19 can include the water intake opening 19*a* opened in the bottom section of the body 11 and a water nozzle (not shown) opened at the stern. The propulsion unit 19 can be configured to eject seawater taken from the water intake opening 19*a* from a water nozzle by a rotational drive of an impeller to generate propulsive force to the body 11.

In a rear end section of the propulsion unit 19, the steering nozzle 19*b* can be provided for changing a direction of the watercraft 10 from the left to the right by rotating and moving a rear section side from the left to the right corresponding to an operation of the steering handlebar 12. At a rear section of the steering nozzle 19*b*, the reverse gate 19*c* can be provided for changing the direction of the watercraft 10 back and forth by moving up and down. In addition, besides each apparatus described above, the watercraft 10 can include a variety of apparatuses for navigation of the watercraft 10 such as electric control apparatuses including a CPU, a ROM, a RAM, a timer, and others, an electric equipment box housing various types of electric apparatuses, a start switch, various sensors, and other devices.

To navigate the watercraft 10 with a structure described above, firstly, a start switch can be operated to turn it in order to start the engine 20, so that the watercraft 10 can be in a state where it can operate. In this case, before the start switch is turned on, in the state where the engine 20 remains stopped, as shown in FIG. 5, the oil (O) remains in the section on both sides of the oil sump 33 excluding the upper section and on the bottom section side of the crankcase 22*a* and the entire oil surface a of the oil (O) is about level. When the engine 20 starts, the feed pump 34*a* and the scavenging pump 35*c* start at the same time, and a portion of the oil (O) can be sent to the crankcase 22*a* and the vapor-liquid separation chamber 31, so that the oil surface (b) (excluding a part in the upper section on the left side) of the oil (O) in the oil sump 33 keeps about level in a position in the vicinity of the upper surface of the lid member 36 as shown in FIG. 6.

Under these conditions, the oil (O) in the main oil sump 33*a* passes the feed pipe 34 and the transfer path 34*b*, and can be supplied to certain sections of the engine 20 including the crankshaft 21 of the inside of the crankcase 22*a* by the operation of the feed pump 34*a*. After lubricating certain sections of the engine 20, the oil (O) drops through the crankcase 22*a* and the opening sections 26*b* and 26*c*, passes mainly the opening 36*a*, and drops into the main oil sump 33*a* of the oil sump 33. Under these conditions, a portion of the oil (O) does not pass the opening 36*a*, and enters into the auxiliary oil sump 33*b*. After lubricating each section of the engine 20, the oil (O) can become entrained with air and blow-by gas generated in the crankcase 22*a* and other portions of the engine 20.

By an operation of the scavenging pump 35*c*, the oil (O) in the auxiliary oil sump 33*b* passes the scavenging pipe 35 and the transfer path 35*d*, and can be sent into the vapor-liquid separation chamber 31. While being held in the vapor-liquid separation chamber 31 for a certain period of time, air and blow-by gas included in the oil (O) are separated from the oil (O). Air and blow-by gas separated from the oil (O) pass the gas exhaust opening 31*e* and the breather pipe 38, and are sent to the breather case 18*b*. The oil (O) from which air and blow-by gas have been removed passes the oil return opening 31*f* and the transfer path 37, and can be returned to the main oil sump 33*a*.

The oil (O) being returned in the main oil sump 33*a* can be supplied into the crankcase 22*a* again by an operation of the feed pump 34*a*, and can become entrained with air and blow-by gases while lubricating each section of the engine 20. This oil (O) can then drop from the crankcase 22*a* to the auxiliary oil sump 33*b* of the oil sump 33 and to the inside of the main oil sump 33*a*. The oil (O), having been entrained with air and blow-by gases, can be sent from the auxiliary oil sump 33*b* to the inside of the vapor-liquid separation chamber 31 by an operation of the scavenging pump 35*c*. The air and blow-by gases can thus be removed and returned mainly into the main oil sump 33*a*. While these processes are repeated, the engine 20 can be lubricated to keep a good operation condition, and the lubricating performance of the oil (O) is not deteriorated.

When an operator sitting on the seat 13 operates the steering handlebar 12 and a throttle lever (not shown), the watercraft 10 starts running in a certain direction and at a certain speed corresponding to each operation. While the watercraft 10 travels, the body 11 inclines in a manner where a bow side is higher than a stern side. However, because rear end opening sections of the feed pipe 34 and the scavenging pipe 35 are in a position on a rear section side of the oil sump case 32, they do not protrude above the oil surface of the oil (O). This prevents air in the oil sump case 32 from entering the oil (O) to be supplied to the crankcase 22*a* and the vapor-liquid separation chamber 31 from the oil sump 33.

The oil intake opening 31*d* for leading the oil (O) into the vapor-liquid separation chamber 31 can be formed in a lower section at a front end of the vapor-liquid separation chamber 31, and the gas exhaust opening 31*e* for exhausting air and blow-by gas can be formed almost at the center between the front end section of the ceiling surface of the vapor-liquid separation chamber 31 and a section where the dividing wall 31*c* can be formed. The oil return opening 3 if for making the oil (O) in the vapor-liquid separation chamber 31 drop downward can be formed in a lower section at a rear end of the vapor-liquid separation chamber 31. Therefore, a flow of the oil (O) from the front section side to the rear section side can be generated in the vapor-liquid separation chamber 31. While the oil (O) flows from the front section side to the rear section side in the vapor-liquid separation chamber 31, air and blow-by gas included in the oil (O) rise upward to the upper section side in the vapor-liquid separation chamber 31.

In this case, air and blow-by gas can be prevented from moving to the rear section side of the vapor-liquid separation chamber 31 by the dividing wall 31*c*, and gather in the upper section on the front section side of the vapor-liquid separation chamber 31. Because the ceiling surface of the section on the front section side of the vapor-liquid separation chamber 31 can be formed on a slope where the front section side can be lower and the rear section side can be higher, the slope is an almost level surface while the watercraft 10 travels. Therefore, in the vicinity of the dividing wall 31*c* in a section on the front section side of the vapor-liquid separation chamber 31, air and blow-by gas do not remain, so that air and blow-by gas efficiently gather on the side of the gas exhaust opening 31*e* to enter the gas exhaust opening 31*e* and to the inside of the breather pipe 38.

In addition, because the oil return opening 31*f* can be formed in the lower section at the rear end of the vapor-liquid separation chamber 31, while the watercraft 10 travels, the oil return opening 31*f* can be in a position in the lowermost section of the vapor-liquid separation chamber 31. Therefore, the oil return opening 3 if can be always blocked by the oil (O), and air can be prevented from entering the oil return opening 31*f* with the oil (O). The dividing wall 31*c* can provide a function which not only prevents air and blow-by gas from going into the rear section side of the vapor-liquid separation chamber 31 but also prevents the oil (O) from swaying in the vapor-liquid separation chamber 31.

As mentioned above, the oil supplying apparatus 30 according to the above embodiments can have, besides the oil sump 33 for reserving the oil (O) to be supplied to the engine 20, the vapor-liquid separation chamber 31 for separating air and blow-by gas from the oil (O). Therefore, by holding the oil (O) including air and blow-by gas in the vapor-liquid separation chamber 31 for a certain period of time, the oil (O) from which air and blow-by gas have been separated can be returned mainly to the main oil sump 33*a* of the oil sump 33. Accordingly, a capacity of the oil sump 33 can be reduced. This downsizes the entire engine 20.

In addition, because the concave section 31*a* forming the vapor-liquid separation chamber 31 can be formed integrally with the uppercase 25 along the side surface of the uppercase 25, a space for providing the vapor-liquid separation chamber 31 can be reduced, and also reductions of the number of components, the number of assembly processes, and a cost can be achieved. Moreover, the oil sump 33 can be provided below the crankcase 22*a* and along the bottom section of the crankcase 22*a*, and the vapor-liquid separation chamber 31 can be provided to the side surface of the uppercase 25 higher than the oil sump 33.

Therefore, the oil sump 33 can be provided by utilizing an unused space below the engine 20 in the engine compartment 14, and the vapor-liquid separation chamber 31 can be provided by utilizing an unused space on side surfaces of the uppercase 25 and the cylinder body 23 whose widths in the engine 20 become small. This makes it possible to efficiently use an unused space in the engine compartment 14. In addition, because the vapor-liquid separation chamber 31 can be in a position higher than the oil sump 33, the oil (O) collected from the vapor-liquid separation chamber 31 to the main oil sump 33*a* of the oil sump 33 drops due to its own weight. Accordingly, the transfer path 37 may solely extend downward from the vapor-liquid separation chamber 31, collecting the oil (O) becomes easier, and a structure of the transfer path 37 becomes simpler.

In some embodiments, the oil intake opening 31*d* can be formed in a lower section at the front end of the vapor-liquid separation chamber 31, the gas exhaust opening 31*e* can be formed at the almost center part between the front end section on the ceiling surface of the vapor-liquid separation chamber 31 and a part where the dividing wall 31*c* can be formed, and the oil return opening 31*f* can be formed in the lower section at the rear end of the vapor-liquid separation chamber 31. Thus, even when the body 11 inclines in a manner where the front section side is in a position higher than the rear section side during navigation of the watercraft 10, the oil return opening 31*f* is not covered with the oil (O), so that the oil (O) from the oil return opening 31*f* to the main oil sump 33*a* of the oil sump 33 can be smoothly collected. In addition, air and blow-by gas from the gas exhaust opening 31*e* can be also efficiently released.

In addition, the engine including an oil supplying apparatus according to the embodiments disclosed above can be applied not only in the contexts mentioned above, but also with other modifications. For example, although the concave section 31*a* of the vapor-liquid separation chamber 31 can be formed integrally with the uppercase 25 and the cylinder body 23 in the embodiments mentioned above, the vapor-liquid separation chamber 31 can be formed with a member separate from the engine main body such as the uppercase 25. As for the mounting place, it is not limited to the side surface of the uppercase 25 or the cylinder body 23, and it can be changed in an appropriate manner. Moreover, arrangements, structures, materials, and others of other parts forming the engine including an oil supplying apparatus according to the present inventions can be changed in an appropriate manner in accordance with the technical range of the present inventions.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An engine for a watercraft having a hull, the engine including an oil supplying apparatus for supplying lubricating oil to moving components of the engine, the oil supplying apparatus comprising:

an oil sump configured to collect oil from the moving components of the engine after the oil has been used to lubricate the moving components of the engine;

a vapor-liquid separation chamber for separating from the oil, air and blow-by gases included in the oil;

a first oil pump connected to the oil sump and the vapor-liquid separator chamber and configured to pump oil reserved in the oil sump to the vapor-liquid separation chamber;

an oil return path defining a passage arranged to return oil, from which air and blow-by gas were separated in the vapor-liquid separation chamber, to the oil sump; and a second oil pump connected to the oil sump and to at least one lubrication passage in the engine and configured to pump oil reserved in the oil sump to the lubrication passage in the engine; wherein the vapor-liquid separation chamber is not connected to the second oil pump in series.

2. An engine comprising an oil supplying apparatus according to claim 1, wherein at least a part of the vapor-liquid separation chamber is disposed on a wall surface of the engine.

3. An engine comprising an oil supplying apparatus according to claim 2, wherein a part of the vapor-liquid separation chamber disposed on the wall surface of the engine is integrally formed with a wall surface of the engine.

4. An engine comprising an oil supplying apparatus according to claim 3, wherein the oil sump is provided below a crankcase in the engine, the vapor-liquid separation chamber being disposed at a position higher than the oil sump.

5. An engine comprising an oil supplying apparatus according to claim 2, wherein the oil sump is provided below a crankcase in the engine, the vapor-liquid separation chamber being disposed at a position higher than the oil sump.

6. An engine comprising an oil supplying apparatus according to claim 1, wherein the oil sump is provided below a crankcase in the engine, the vapor-liquid separation chamber being disposed at a position higher than the oil sump.

7. An engine comprising an oil supplying apparatus according to claim 6, wherein the vapor-liquid separation chamber is provided on a sidewall that extends generally parallel to a crankshaft of the engine.

8. An engine comprising an oil supplying apparatus according to claim 6, wherein the vapor-liquid separation chamber is formed in parallel with a longitudinal direction of a body of the watercraft to extend in a fore-and-aft direction, an oil intake opening communicating with the first oil pump being formed in a front section of the vapor-liquid separation chamber, an oil return opening communicating with the oil return path being formed in a rear section of the vapor-liquid separation chamber, and a gas exhaust opening for exhausting air and blow-by gases separated from oil formed between the oil intake opening and the oil return opening in the vapor-liquid separation chamber and above the oil intake opening and the oil return opening.

9. An engine comprising an oil supplying apparatus according to claim 1, wherein the oil return path defines a passage arranged to return oil to the oil sump from the vapor-liquid separation chamber, without passing through a crankcase of the engine.

10. An engine comprising an oil supplying apparatus according to claim 1, wherein the first oil pump is configured to pump oil reserved in the oil sump to the vapor-liquid separation chamber without first lubricating the moving components of the engine.

11. An engine comprising an oil supplying apparatus according to claim 1, wherein the vapor-liquid separation chamber comprises a bottom and the oil sump comprises a top, the bottom of the vapor-liquid separation chamber being positioned above the top of the oil sump.

12. An engine comprising an oil supplying apparatus according to claim 1, wherein the oil sump defines a first enclosed interior volume of space, the vapor-liquid separation chamber defining a second enclosed interior volume of space, the second interior volume of space being independent and outside of the first interior volume of space.

13. An engine comprising at least one moveable internal component, at least one engine lubrication passage extending to the at least one moveable component and configured to guide liquid lubricant to the at least one moveable component, a lubricant sump configured to collect liquid lubricant from the at least one moveable component after the liquid lubricant is used to lubricate the at least one moveable internal component, a vapor separator configured to separate vapors including at least one of air and blow-by gases from the liquid lubricant, the vapor separator having a vapor separator inlet and a vapor separator outlet connected to the sump so as to allow liquid lubricant to flow out of the vapor separator to the sump, a first lubricant pump having a first pump inlet connected to the sump and a first pump outlet connected to the vapor separator inlet and configured to pump the liquid lubricant from the sump to the vapor separator through the vapor separator inlet, and a second lubricant pump having a second pump inlet connected to the sump and a second pump outlet connected to the at least one engine lubrication passage and arranged to guide liquid lubricant to the at least one moveable component of the engine through the at least one engine lubrication passage; wherein the vapor separator is not connected to the second pump in series.

14. An engine comprising at least one moveable internal component, at least one engine lubrication passage extending to the at least one moveable component and configured to guide liquid lubricant to the at least one moveable component, a lubricant sump configured to collect liquid lubricant from the at least one moveable component after the liquid lubricant is used to lubricate the at least one moveable internal component, a vapor separator configured to separate vapors including at least one of air and blow-by gases from the liquid lubricant, the vapor separator having a vapor separator inlet and a vapor separator outlet connected to the sump so as to allow liquid lubricant to flow out of the vapor separator to the sump, a first lubricant pump having a first pump inlet connected to the sump and a first pump outlet connected to the vapor separator inlet and configured to pump the liquid lubricant from the sump to the vapor separator through the vapor separator inlet, and a second lubricant pump having a second pump inlet connected to the sump and a second pump outlet connected to the at least one engine lubrication passage and arranged to guide liquid lubricant to the at least one moveable component of the engine through the at least one engine lubrication passage, wherein the first pump, the second pump, the sump and the vapor separator are connected such that, during operation of the first and second pumps, liquid lubricant flows in first and second parallel lubrication loops, the first lubrication loop being defined between the sump and the vapor separator, the second lubrication loop being defined between the sump and the at least one moveable component of the engine, wherein the vapor separator is not connected in series with the second pump.

15. The engine according to claim 13 wherein the engine comprises an engine body, at least a portion of the vapor separator being defined by a portion of the engine body.

16. The engine according to claim 13 wherein the engine comprises an engine body, at least a portion of the vapor separator being defined by a portion of the engine body.

17. An engine comprising an oil supplying apparatus according to claim 13, wherein the first oil pump is configured to pump oil reserved in the oil sump to the vapor-liquid separation chamber without first lubricating the moving components of the engine.

18. An engine comprising an oil supplying apparatus according to claim 13, wherein the vapor-liquid separation chamber comprises a bottom and the oil sump comprises a top, the bottom of the vapor-liquid separation chamber being positioned above the top of the oil sump.

19. An engine comprising an oil supplying apparatus according to claim 13, wherein the oil sump defines a first enclosed interior volume of space, the vapor-liquid separation chamber defining a second enclosed interior volume of space, the second interior volume of space being independent and outside of the first interior volume of space.

20. An engine comprising at least one moveable internal component, a lubricant sump configured to collect liquid lubricant used to lubricate the at least one moveable internal component, a vapor separator configured to separate vapors from liquid lubricant, and means for defining first and second parallel lubricant circulation loops, the vapor separator being connected to the first lubricant circulation loop but not the second lubricant circulation loop.

21. The engine according to claim 20 wherein the vapor separator is formed from part of a body of the engine.

22. An engine comprising an oil supplying apparatus according to claim 20, wherein the means for defining a first parallel lubricant circulation loop comprises a first lubricant pump configured to pump lubricant reserved in the lubricant sump to the vapor-liquid separation chamber without first lubricating the moving components of the engine.

23. An engine comprising an oil supplying apparatus according to claim 20, wherein the vapor separator comprises a bottom and the lubricant sump comprises a top, the bottom of the vapor separator being positioned above the top of the lubricant sump.

24. An engine comprising an oil supplying apparatus according to claim 20, wherein the lubricant sump defines a first enclosed interior volume of space, the vapor separator defining a second enclosed interior volume of space, the second interior volume of space being independent and outside of the first interior volume of space.

* * * * *